US006685988B2

(12) United States Patent
Van Steenkiste et al.

(10) Patent No.: US 6,685,988 B2
(45) Date of Patent: Feb. 3, 2004

(54) KINETIC SPRAYED ELECTRICAL CONTACTS ON CONDUCTIVE SUBSTRATES

(75) Inventors: Thomas Hubert Van Steenkiste, Ray, MI (US); George Albert Drew, Warren, OH (US); Daniel William Gorkiewicz, Washington, MI (US); Bryan A. Gillispie, Warren, MI (US)

(73) Assignee: Delphi Technologies, Inc., Troy, MI (US)

( * ) Notice: Subject to any disclaimer, the term of this patent is extended or adjusted under 35 U.S.C. 154(b) by 60 days.

(21) Appl. No.: 09/974,243

(22) Filed: Oct. 9, 2001

(65) Prior Publication Data

US 2003/0077952 A1 Apr. 24, 2003

(51) Int. Cl.[7] ..... B05D 1/02; B05D 5/02

(52) U.S. Cl. ..... 427/424; 427/427; 427/123

(58) Field of Search ..... 427/123, 124, 427/125, 250, 255.25, 327, 251, 421, 424, 426, 427; 118/308; 239/8, 13

(56) References Cited

U.S. PATENT DOCUMENTS

| | | | | |
|---|---|---|---|---|
| 3,100,724 A | 8/1963 | Rocheville | ..... | 118/308 |
| 3,993,411 A | 11/1976 | Babcock et al. | ..... | 403/271 |
| 4,263,335 A | 4/1981 | Wagner et al. | ..... | 427/29 |

(List continued on next page.)

OTHER PUBLICATIONS

Van Steenkiste, et al; *Kinetic Spray Coatings*; in Surface & Coatings Technology III; 1999; pp. 62–71 (no month).

Liu, et al; *Recent Development in the Fabrication of Metal, Matrix–Particulate Composites Using Powder Metallurgy Techniques*; in Journal of Material Science 29; 1994; pp. 1999–2007; National University of Singapore, Japan (no month).

Papyrin; *The Cold Gas–Dynamic Spraying Method a New Method for Coatings Deposition Promises a New Generation of Technologies; Novosibirsk, Russia*. (no date).

McCune, al; Characterization of Copper and Steel Coatings Made by the Cold Gas–Dynamic Spray Method; National Thermal Spray Conference. (no date).

Alkhimov, et al; *A Method of "Cold" Gas–Dynamic Deposition; Sov. Phys. Kokl. 36*( Dec. 12, 1990; pp. 1047–1049.

Dykuizen, et al; *Impact of High Velocity Cold Spray Particles*; in Journal of Thermal Spray Technology 8(4); 1999; pp. 559–564 (no month).

Swartz, et al; *Thermal Resistance At Interfaces; Appl. Phys. Lett.*, vol. 51, No 26, Dec. 28, 1987; pp. 2201–2202.

Davis, et al; *Thermal Conductivity of Metal–Matrix Composlites; J. Appl. Phys. 77 (10)*,May 15, 1995; pp. 4494–4960.

Stoner et al; *Measurements of the Kapitza Conductance between Diamond and Several Metals*; Physical Review Letters, vol. 68, No. 10; Mar. 9, 1992; pp. 1563–1566.

Stoner et al; *Kapitza conductance and heat flow between solids at temperatures from 50 to 300K*; Physical Review B, vol. 48, No. 22, Dec. 1, 1993–II; pp. 16374;16387.

Johnson et al; *Diamond/Al metal matrix composites formed by the pressureless metal infiltration process*; J. Mater, Res., vol. 8, No. 5, May 1993; pp. 11691173.

(List continued on next page.)

*Primary Examiner*—Michael La Villa
(74) *Attorney, Agent, or Firm*—Scott A. McBain

(57) ABSTRACT

The present invention is directed to electrical contacts that comprise spaced electrically conductive particles embedded and bonded into the surface of conductors in which the particles have been kinetically sprayed onto the conductors with sufficient energy to form direct mechanical bonds between the particles and the conductors in a pre-selected location and particle number density that promotes high surface-to-surface contact and reduced contact resistance between the conductors.

10 Claims, 3 Drawing Sheets

U.S. PATENT DOCUMENTS

| | | | | |
|---|---|---|---|---|
| 4,606,495 | A | 8/1986 | Stewart, Jr. et al. | 228/183 |
| 4,891,275 | A | 1/1990 | Knoll | 428/650 |
| 4,939,022 | A | 7/1990 | Palanisamy | 428/209 |
| 5,187,021 | A | 2/1993 | Vydra et al. | 428/607 |
| 5,271,965 | A | 12/1993 | Browning | 427/446 |
| 5,302,414 | A | 4/1994 | Alknimor et al. | 427/192 |
| 5,340,015 | A | 8/1994 | Hira et al. | 228/205 |
| 5,395,679 | A | 3/1995 | Myers et al. | 428/209 |
| 5,424,101 | A | 6/1995 | Atkins et al. | 427/448 |
| 5,464,146 | A | 11/1995 | Zalvzec et al. | 228/208 |
| 5,476,725 | A | 12/1995 | Papich et al. | 428/654 |
| 5,527,627 | A | 6/1996 | Lautzenhiser et al. | 428/615 |
| 5,593,740 | A | 1/1997 | Strumbon et al. | 427/577 |
| 5,795,626 | A | 8/1998 | Grabel et al. | 427/458 |
| 5,854,966 | A | 12/1998 | Kampe et al. | 419/67 |
| 5,875,626 | A | 3/1999 | Cromartie | 57/1 R |
| 5,894,054 | A | 4/1999 | Paruchuri et al. | 428/642 |
| 5,907,761 | A | 5/1999 | Tohma et al. | 428/553 |
| 5,952,056 | A | 9/1999 | Jordan et al. | 427/455 |
| 5,989,310 | A | 11/1999 | Chu et al. | 75/685 |
| 6,033,622 | A | 3/2000 | Maruyama | 419/35 |
| 6,051,045 | A | 4/2000 | Narula et al. | 75/233 |
| 6,051,277 | A | 4/2000 | Claussen et al. | 427/376.3 |
| 6,074,737 | A | 6/2000 | Jordan et al. | 428/312.8 |
| 6,129,948 | A | 10/2000 | Plummet et al. | 427/202 |
| 6,139,913 | A | 10/2000 | Van Steenkiste et al. | 427/191 |
| 6,283,386 | B1 | 9/2001 | Van Steenkiste et al. | 239/427 |
| 6,465,039 | B1 * | 10/2002 | Pinkerton et al. | 427/132 |
| 2002/0073982 | A1 * | 6/2002 | Shaikh et al. | 123/688 |
| 2003/0039856 | A1 * | 2/2003 | Gillispie et al. | 428/650 |

OTHER PUBLICATIONS

Rajan et al; *Reinforcement coatings and interfaces in Aluminum Metal Matrix Composites*; pp. 3491–3503. 1998 (no month).

*LEC Manufacturing and Engineering Capabilities*; Lanxide Electronic Components, Inc. (no date).

Dykhuizen et al; *Gas Dynamic Principles of Cold Spray*; Journal of Thermal Spray Technology; 06–98; pp. 205–212. Jun. 1998.

McCune et al; *An Exploration of the Cold Gas–Dynamic Spray Method For Several Materials Systems*; (no date).

Ibrahim et al; *Particulate Reinforced Metal Matrix Composites—A Review; Journal of Materials Science 26; pp. 1137–1156*. 1991 (no month).

* cited by examiner

KINETIC SPRAYED ELECTRICAL CONTACTS ON CONDUCTIVE SUBSTRATES

TECHNICAL FIELD

The present invention is directed to electrical contacts that comprise spaced particles embedded into the surface of conductors in which the particles have been kinetically sprayed onto the conductors with sufficient energy to form direct mechanical bonds between the particles and the conductors in a pre-selected location and particle number density that promotes high surface-to-surface contact and reduced contact resistance between the conductors. The method of making such electrical contacts is also provided.

INCORPORATION BY REFERENCE

U.S. Pat. No. 6,139,913, "Kinetic Spray Coating Method and Apparatus," is incorporated by reference herein.

BACKGROUND OF THE INVENTION

Most electrical contacts are copper or copper alloy conductors with a tin-plated surface layer. The tin surface layer is a single continuous layer directly bonded to a clean non-oxidized copper substrate in order to promote maximum conductance between conductors while limiting resistance from the tin-copper metallic bond. Tin is used as a surface layer since it is substantially softer than copper and may be recurrently wiped to provide a fresh de-oxidized surface for metal-to-metal connection between conductors.

Electrical contacts have been traditionally made by electroplating a layer of tin to copper substrates followed by stamping out individual conductors. The copper substrates must be cleaned prior to placement in the electroplating bath to remove any oxidized surface layers that may otherwise create additional electrical resistance. The substrates are coated to a thickness of about 3 to 5 microns of tin.

Because most electrical contacts undergo repeated connections and reconnections, increasing the thickness of the tin surface layer correlates well with the longevity and durability of the contact. However, due to processing limitations and increased frictional properties, the threshold thickness for electroplating tin onto copper is about 5 microns.

While it may be possible to use other available coating methods to increase coating thickness, methods that rely on melting and/or depositing the tin in a molten state are undesirable because, unless conducted in the absence of oxygen, they will introduce significant oxidation into the tin surface layer. Also, due to the increased costs of use, such methods are not practical.

One of the main problems with present electrical contacts is debris build-up due to fretting on the contact surface. With relative movement of mated electrical contacts, a small portion of the oxidized surface layer is rubbed away to expose a fresh electrical connection surface. The portion rubbed away usually does not flake off, but instead remains adjacent to the contact point and begins to create a build-up of oxidized debris. It is well known that this oxidized debris becomes a source for additional resistance and degradation of the contact's conductance.

Prior to the present invention, removal of this debris has been impractical. In the prior art, the solution has been to provide continuous layer coatings that have been believed to result in maximum surface area for conductance.

A new technique for producing coatings by kinetic spray, or cold gas dynamic spray, was recently reported in an article by T. H. Van Steenkiste et al., entitled "Kinetic Spray Coatings," published in Surface and Coatings Technology, vol. 111, pages 62–71, Jan. 10, 1999. The article discusses producing continuous layer coatings having low porosity, high adhesion, low oxide content and low thermal stress. The article describes coatings being produced by entraining metal powders in an accelerated air stream and projecting them against a target substrate. It was found that the particles that formed the coating did not melt or thermally soften prior to impingement onto the substrate.

This work improved upon earlier work by Alkimov et al. as disclosed in U.S. Pat. No. 5,302,414, issued Apr. 12, 1994. Alkimov et al. disclosed producing dense continuous layer coatings with powder particles having a particle size of from 1 to 50 microns using a supersonic spray.

The Van Steenkiste article reported on work conducted by the National Center for Manufacturing Sciences (NCMS) to improve on the earlier Alkimov process and apparatus. Van Steenkiste et al. demonstrated that Alkimov's apparatus and process could be modified to produce kinetic spray coatings using particle sizes of greater than 50 microns and up to about 106 microns.

This modified process and apparatus for producing such larger particle size kinetic spray continuous layer coatings is disclosed in U.S. Pat. No. 6,139,913, Van Steenkiste et al., that issued on Oct. 31, 2000. The process and apparatus provide for heating a high pressure air flow up to about 650° C. and accelerating it with entrained particles through a de Laval-type nozzle to an exit velocity of between about 300 m/s (meters per second) to about 1000 m/s. The thus accelerated particles are directed toward and impact upon a target substrate with sufficient kinetic energy to impinge the particles to the surface of the substrate. The temperatures and pressures used are sufficiently lower than that necessary to cause particle melting or thermal softening of the selected particle. Therefore, no phase transition occurs in the particles prior to impingement.

SUMMARY OF THE INVENTION

The present invention is directed to kinetic spraying electrically conductive materials onto conductive substrates. More particularly, the present invention is directed to electrical contacts that comprise spaced electrically conductive particles embedded into the surface of conductors in which the particles have been kinetically sprayed onto the conductors with sufficient energy to form direct mechanical bonds between the particles and the conductors in a pre-selected location and particle number density that promotes high surface-to-surface contact and reduced contact resistance between the conductors. The particle number density, as used herein, defines the quantity of spaced particles deposited within a selected location.

Utilizing the apparatus disclosed in U.S. Pat. No. 6,139,913, the teachings of which are incorporated herein by reference, it was recognized that thick continuous layer coatings could be produced on conductive substrates in the production of electrical contacts. Such thick coatings are practical due to the mechanical bonds that are formed by impact impingement of the particles onto the substrate. These thicker continuous layer coatings are beneficial in producing electrical contacts since they provide low porosity, low oxide, low residual stress coatings that result in electrical contacts having greater longevity and durability.

When the feed rate of the particles into the gas stream is reduced, it is difficult to maintain a uniform output of particles necessary to form a continuous layer. The production of a continuous layer of particles is even more problematic if the substrate is moved across the nozzle or vice versa.

The present inventors used this process to embed a large number of spaced apart particles in the surface of conductors to provide multiple contact points that are particularly useful for electrical contacts. A large number of spaced particles embedded in the surface of the conductors provide a structure having a surface layer with a plurality of particles forming ridges and valleys. Each embedded particle defines a ridge, and the space in between particles defines a valley. The ridges provide multiple contact points for conductance while the spaces provide multiple avenues for the removal of debris produced from repeated fretting. Thus the discontinuous nature of the particle coating caused by the method of application leads to an electrically conductive contact that can with stand repeated fretting, as discussed further below.

In addition, the present invention provides the means for controlling the location of deposition of kinetic sprayed particles and the particle number density deposited in that location on the conductive substrate by simply controlling the feed rate of particles into the gas stream and the traverse speed of the substrate across the apparatus and/or nozzle. By doing so, the spray of conductive materials is controlled so that particles are only deposited on those portions that are to be stamped out as conductors.

This provides a tremendous advantage in processing. It substantially reduces waste of the conductive particles and aids in the reuse of substrate materials. Furthermore, there are no plating bath waste products or associated disposal costs.

In a typical coating procedure it is necessary to pre-clean the surface that is to be coated to remove the oxide layer, the present process eliminates this step. The impact of the initial kinetic sprayed particles on the surface is sufficiently forceful to fracture any oxide layer on the surface. The subsequent particles striking the now cleaned surface stick. As a result, electrical contacts produced by kinetic spraying spaced electrically conductive particles are particularly useful.

The present invention provides that particles can be kinetic sprayed onto conductors with sufficient energy to form direct mechanical bonds between the particles and the conductors in a pre-selected location and particle number density that promotes high surface-to-surface contact between the conductors with reduced contact resistance.

DESCRIPTION OF THE PREFERRED EMBODIMENT

Figure 1:
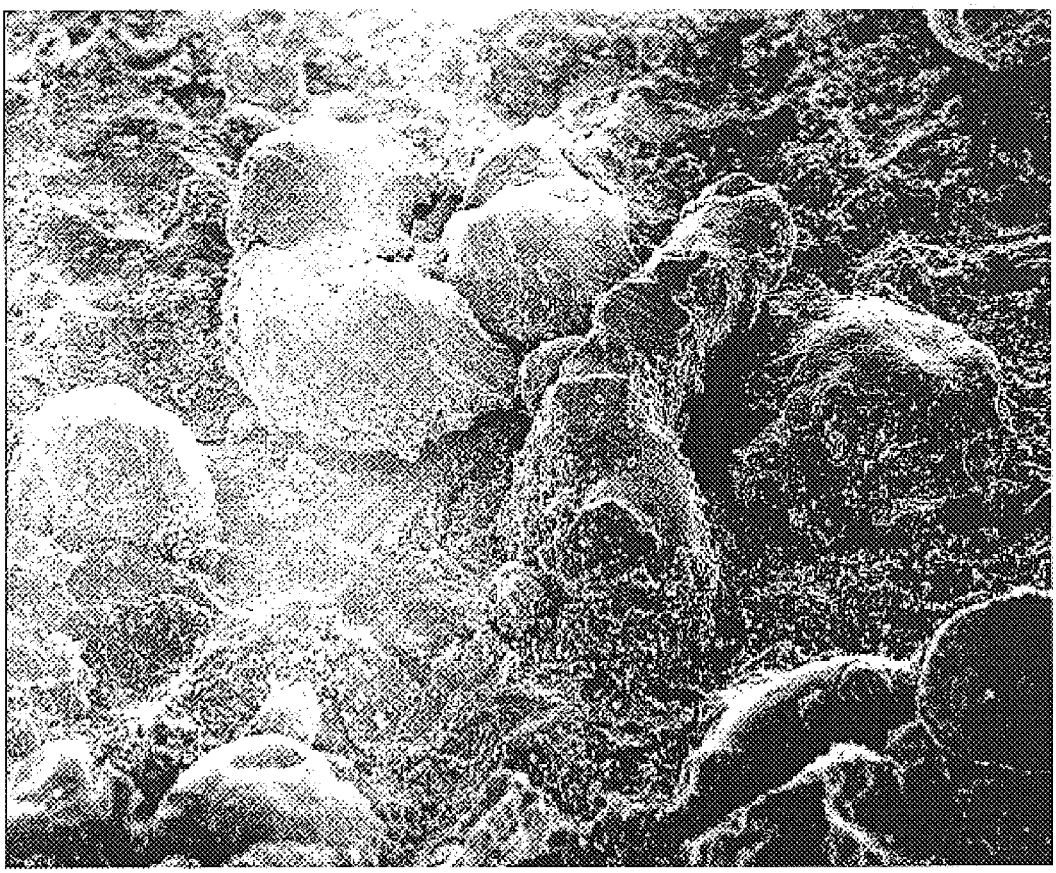
FIG. 1 is a scanning electron micrograph of an electrical contact of the present invention comprising a copper conductor with kinetic sprayed tin particles, having an original particle diameter of about 50 to 65 microns, embedded on its surface.

An electrical contact of the present invention preferably has a contact resistance of less than about 10 milli-ohms and more preferably less than about 2 milli-ohms (when measured with a 1 Newton load and a 1.6 mm radius gold probe per ASTM B667). However, it is well recognized that electrical contacts of any contact resistance fall within the scope of the invention. The electrical contact comprises first and second mated conductors. While more than two conductors may be used to form an electrical contact, two are preferred. The conductors are stamped out of conductive substrates made of any suitable conductive material including, but not limited, to copper, copper alloys, aluminum, brass, stainless steel and tungsten. It is preferred, however, that the substrate be made of copper.

In each contact of the present invention, at least one of the conductors comprises a plurality of spaced particles that have been embedded into the surface of the conductor in a pre-selected location and particle number density. As contemplated, the spaced particles are embedded and bonded into the surface using the kinetic spray process as described herein and as further generally described in U.S. Pat. No. 6,139,913 and the Van Steenkiste et al article ("Kinetic Spray Coatings," published in Surface and Coatings Technology, Vol. III, pages 62–71, Jan. 10, 1999) [, both of which are incorporated herein by reference].

The particles may be selected from any electrically conductive particle. Due to the impact of the particle on the substrate, it has been found that it is no longer necessary to select the particle from a material that is softer than the material being selected for the conductors. Any electrically conductive particle, including mixtures thereof, may be used in the present invention, including for example, particles comprising monoliths, composites and alloys. Suitable monolithic conductive particles include, for example, tin, silver, gold, and platinum; suitable composite particles include, for example, metal/metal composites of metals that do not easily form alloys; and suitable alloys include, for example, alloys of tin, such as tin-copper, tin-silver, tin-lead and the like. In the present invention, tin or mixtures with tin are preferred. It has been found that particles having a nominal diameter of about 25 microns to about 106 microns are suitable, but the preferred range has a nominal diameter of greater than about 50 microns and more preferably have a nominal diameter of about 75 microns. The term "nominal diameter" refers to a "nominal average particle size.

Each embedded particle, due to the kinetic impact force, flattens into a nub-like structure with an aspect ratio of about 5 to 1, reducing in height to about one third of its original diameter. The nubs are discontinuous and define ridges for conductance when mating the conductors and the spaces in between the nubs define valleys for removal of debris produced from the rubbing, or "fretting," that occurs from relative movement between mated contacts.

A scanning electron micrograph of the surface of an electrical contact of the present invention is shown in FIG. 1. The lumps (or nubs) are the tin particles and the substrate is copper. The original particle size was about 50 to 65 microns.

Electrical contacts of the present invention are preferably made using the apparatus disclosed in U.S. Pat. No. 6,139,913. However, the process used is modified from that disclosed in the prior patent in order to achieve the discontinuous layer of particles contemplated in the present invention. The operational parameters are modified to obtain an exit velocity of the particles from the de Laval-type nozzle of between about 300 m/s (meters per second) to less than about 1000 m/s. The substrate is also moved in relation to the apparatus and/or the nozzle to provide movement along the surface of the substrate at a traverse speed of about 1 m/s to about 10 m/s, and preferably about 2 m/s, adjusted as necessary to obtain the discontinuous particle layer of the present invention. The particle feed rate may also be adjusted to obtain the desired particle number density. The temperature of the gas stream is also modified to be in the range of about 100° C. to about 550° C., ie. lower than in a typical kinetic spray process. More preferably, the temperature range is from 100° C. to 300° C., with about 200° C. being the most preferred operating temperature especially for kinetic spraying tin onto copper.

It will be recognized by those of skill in the art that the temperature of the particles in the gas stream will vary depending on the particle size being kinetic sprayed and the main gas stream temperature. Since these temperatures are substantially less than the melting point of the original particles, even upon impact, there is no change of the solid phase of the original particles due to transfer of kinetic and thermal energy, and therefore no change in their original physical properties.

In a preferred embodiment of the present invention, the electrical contact has a contact resistance of about 1 to 2 milli-ohms and comprises first and second mating copper conductors. Each of these copper conductors further comprises a plurality of spaced tin particles kinetic sprayed onto the surface of the conductors in a pre-selected location and particle number density. The kinetic sprayed particles have an original nominal particle diameter of about 75 microns and are embedded into the surface of each conductor forming a direct metallic bond between the tin and copper. The direct bond is formed when the kinetic sprayed particle impacts the copper surface and fractures the oxidized surface layer and subsequently forms a direct metal-to-metal bond between the tin particle and the copper substrate. Each embedded tin particle has a nub-like shape with the average height of each particle being about 25 microns from the surface of the copper substrate.

In the preferred process for making electrical contacts of the invention using the apparatus disclosed in U.S. Pat. No. 6,139,913, tin particles are introduced into a focused air stream, pre-heated to about 200° C., and accelerated through a de Laval-type nozzle to produce an exit velocity of about 300 m/s (meters per second) to less than about 1000 m/s. The entrained particles gain kinetic and thermal energy during transfer. The particles are accelerated through the nozzle as the surface of a copper substrate begins to move across the apparatus and/or nozzle at a traverse speed of about 2 m/s within a pre-selected location on the substrate that approximates the shape of the copper conductor contemplated to be stamped out of the copper substrate. While the pattern of particle deposition is random, the location and particle number density are controlled. Upon exiting the nozzle, the tin particles are directed and impacted continuously onto the copper substrate forming a plurality of spaced electrically conductive particles. Upon impact the kinetic sprayed particles transfer substantially all of their kinetic and thermal energy to the copper substrate, fracturing any oxidation layer on the surface of the copper substrate while simultaneously mechanically deforming the tin particle onto the surface. Immediately following fracture, the particles become embedded and mechanically bond the tin to the copper via a metallic bond. The resulting deformed particles have a nub-like shape with an aspect ratio of about 5 to 1.

Figure 2:
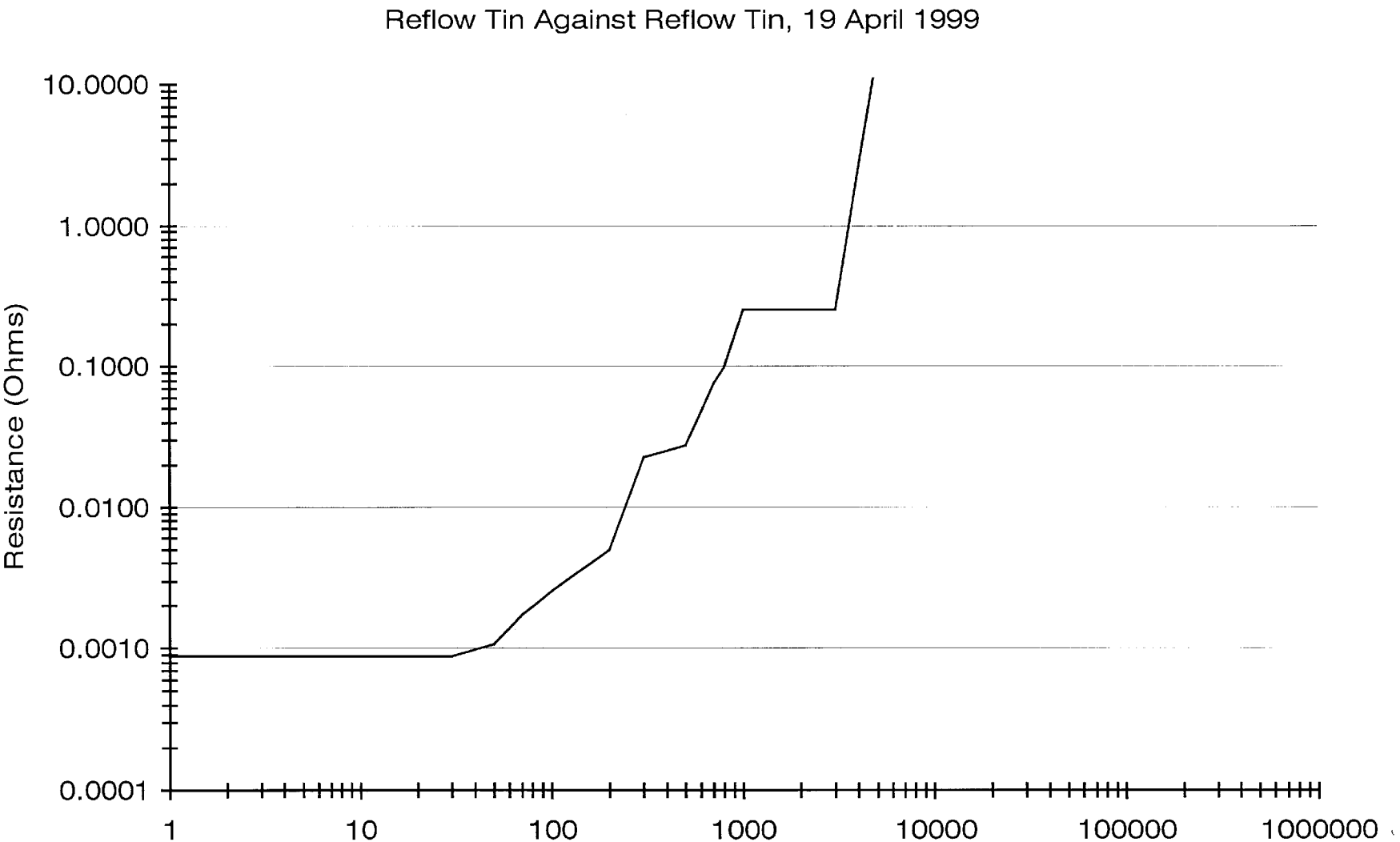
FIG. 2 is a chart that shows the contact resistance as a function of fretting cycles of a prior art electroplated tin electrical contact.
Figure 3:
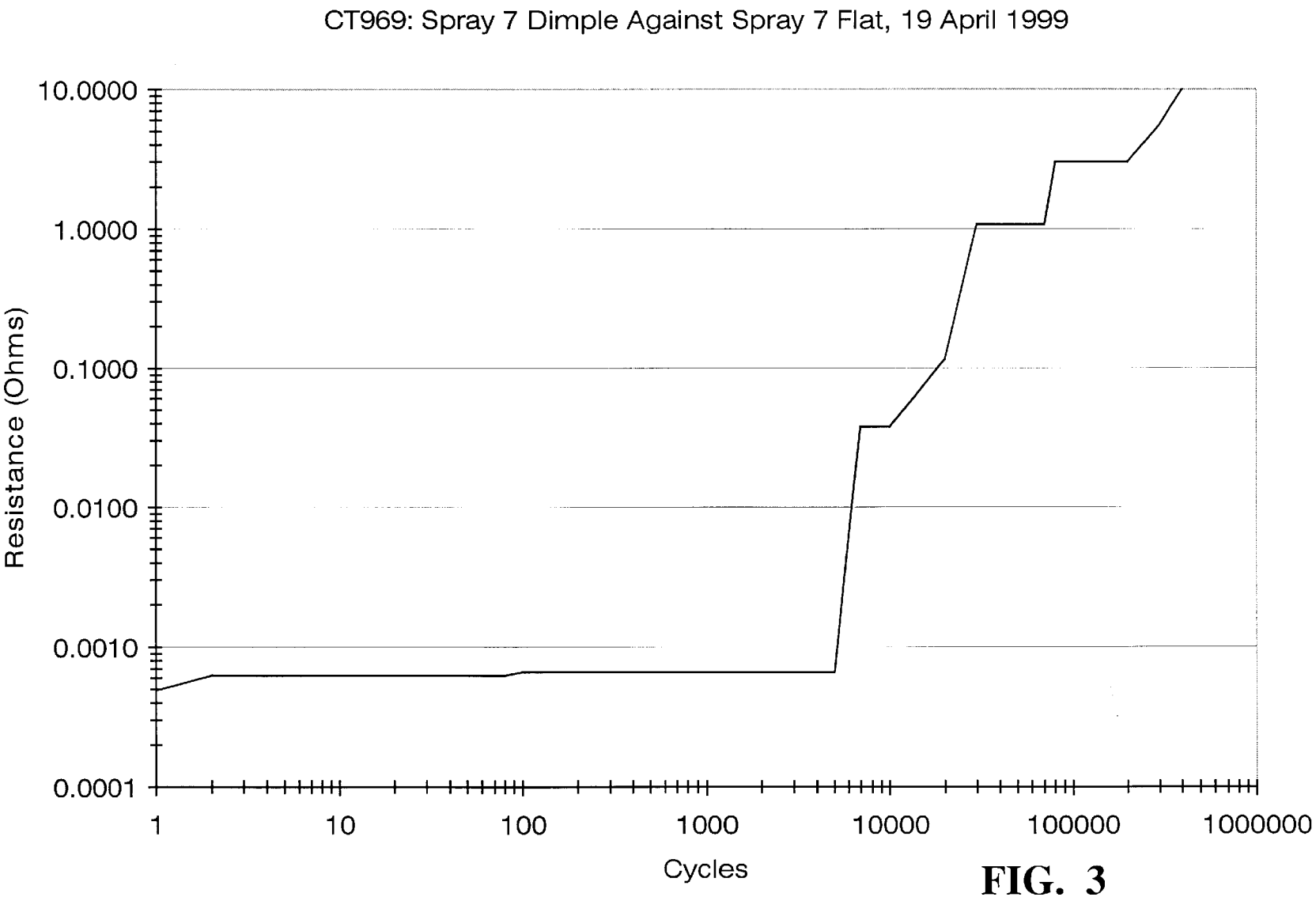
FIG. 3 is a chart that shows the contact resistance as a function of fretting cycles of a tin-copper electrical contact made according to the present invention.

Performance results of an electrical contact produced according to the present invention and a standard electroplated contact are depicted in FIGS. 2 and 3. FIG. 2 shows the contact resistance as a function of fretting cycles of a prior art electrical contact having two copper conductors electroplated with tin. The electroplating forms a continuous layer as opposed to the discontinuous layer formed by the present process. The results show that the contact initially maintained a resistance of less than about 1 milli-ohm for the first 50 cycles, but then resistance began increasing to reach about 10 milli-ohms at about 120 cycles and over 100 milli-ohms at about 1000 cycles. FIG. 3 shows the contact resistance as a function of fretting cycles of a tin-copper electrical contact made according to the present invention in which two copper conductors were kinetic sprayed with tin particles. The results show that the contact initially maintained a resistance of less than about 1 milli-ohm for about 5000 cycles before resistance began increasing. As demonstrated by FIGS. 2 and 3, the present invention can produce improved electrical contacts that maintain a low resistance over time.

The table that follows shows other representative results of electrical contacts produced according to the present invention. Contact resistance was tested according to the industry standard. The spots were randomly selected and the contact resistance in mili Ohms is shown for each spot (NT=not tested). The temperature indicated was the temperature of the pre-heated air stream.

| | | CONTACT RESISTANCE | | | | | | |
|---|---|---|---|---|---|---|---|---|
| Sample | Load (g) | Spot 1 (m Ω) | Spot 2 (m Ω) | Spot 3 (m Ω) | Spot 4 (m Ω) | Spot 5 (m Ω) | Average (m Ω) | Standard Deviation |
| 801a | 100 | 1.43 | 0.85 | 1.62 | 1.17 | 0.88 | 1.19 | 0.34 |
| (150° C.) | 200 | 0.76 | 0.52 | 1.15 | 0.80 | 0.57 | 0.78 | 0.23 |
| 801b | 100 | 0.92 | 0.91 | 0.86 | 0.99 | 1.17 | 0.97 | 0.12 |
| (200° C.) | 200 | 0.62 | 0.60 | 0.64 | 0.55 | 0.82 | 0.67 | 0.09 |
| 901a | 100 | 1.14 | 1.00 | 1.30 | 1.20 | 1.75 | 1.28 | 0.29 |
| (150° C.) | 200 | NT | NT | 0.85 | 0.90 | 1.20 | 0.98 | 0.19 |
| 901b | 100 | 2.19 | 0.89 | 0.89 | 0.95 | 1.36 | 1.26 | 0.56 |
| (100° C.) | 200 | NT | NT | NT | NT | NT | NT | |

While the preferred embodiment of the present invention has been described so as to enable one skilled in the art to practice the electrical contacts of the present invention, it is to be understood that variations and modifications may be employed without departing from the concept and intent of the present invention as defined in the following claims. The preceding description is intended to be exemplary and should not be used to limit the scope of the invention. The scope of the invention should be determined only by reference to the following claims.

What is claimed is:

1. A process for forming an electrical connector comprising the steps of:

a. entraining a plurality of electrically conductive particles having a nominal average particle size of greater than 50 microns into a gas stream having a temperature of from 100° Celsius to 550° Celsius, thereby imparting kinetic and thermal energy to said particles; and b. directing said gas stream and said particles through a nozzle toward an electrically conductive surface while moving said surface in relation to said nozzle at a selected speed thereby embedding said particles onto said surface and forming a discontinuous layer of spaced particles on said surface.

2. The process of claim 1 wherein step a) comprises entraining a plurality of electrically conductive particles having a particle size of equal to or greater than 75 microns into said gas stream.

3. The process of claim 1 wherein step b) comprises directing said gas stream and said particles through a nozzle and accelerating said particles to a velocity between 300 to 1000 meters per second.

4. The process of claim 1 wherein step b) further comprises moving said surface in relation to said nozzle at a speed of from 1 meter per second to 10 meters per second.

5. The process of claim 1 wherein step a) comprises selecting as the electrically conductive surface at least one of copper, aluminum, brass, stainless steel and tungsten.

6. The process of claim 1 wherein step a) comprises entraining a plurality of electrically conductive particles into a gas stream having a temperature of from 100° Celsius to 300° Celsius.

7. The process of claim 1 wherein step a) comprises entraining a plurality of electrically conductive particles into a gas stream having a temperature of 200° Celsius.

8. The process of claim 1 wherein step a) comprises selecting as the electrically conductive particles at least one of tin, silver, gold, platinum, or a metal alloy.

9. The process of claim 8 comprising selecting as the electrically conductive particles tin or a tin alloy.

10. The process of claim 9 comprising selecting as the electrically conductive particles at least one of a tin-copper, a tin-silver, or a tin-lead alloy.

* * * * *